United States Patent [19]

Nieuwendijk et al.

[11] Patent Number: 4,612,420

[45] Date of Patent: Sep. 16, 1986

[54] LOUDSPEAKER SYSTEM FOR CONVERTING A DIGITIZED ELECTRIC SIGNAL INTO AN ACOUSTIC SIGNAL

[75] Inventors: Joris A. M. Nieuwendijk; Wilhelmus D. A. M. Van Gijsel, both of Eindhoven, Netherlands

[73] Assignee: U.S. Philips Corporation, New York, N.Y.

[21] Appl. No.: 651,379

[22] Filed: Sep. 17, 1984

[30] Foreign Application Priority Data

Sep. 15, 1983 [NL] Netherlands ..... 8303184

[51] Int. Cl.[4] ..... H04R 9/00; H04R 3/08; H04R 7/06; H04R 9/06

[52] U.S. Cl. ..... 179/115.5 PV; 179/115.5 VC; 179/115 R; 179/181 R; 329/193; 370/110.3; 381/117

[58] Field of Search ..... 179/115.5 PV, 115.5 R, 179/115.5 VC, 115 R, 181 R; 381/117, 111, 120, 121, 96; 329/193; 455/614; 370/110.3

[56] References Cited

U.S. PATENT DOCUMENTS 4,481,660 11/1984 de Koning et al. ..... 381/120

FOREIGN PATENT DOCUMENTS 56-68098 6/1981 Japan ..... 179/115 R
186897 11/1982 Japan ..... 381/111 R
57-186898 11/1982 Japan ..... 381/117
58-31699 2/1983 Japan ..... 179/115.5 VC
121897 7/1983 Japan ..... 381/111 R

*Primary Examiner*—Gene Z. Rubinson
*Assistant Examiner*—Danita R. Byrd
*Attorney, Agent, or Firm*—Robert T. Mayer; Bernard Franzblau

[57] ABSTRACT

An electrodynamic transducer (1) for use in a loudspeaker system for converting an n-bit digitized electric signal (11) into an acoustic signal comprises n voice-coil devices (4.1, 4.2, . . . 4.n) which cooperate with a magnet system (3). The voice-coil devices each comprise a conductor whose length is the same for all the voice-coil devices. The areas of the perpendicular cross-sections of the conductors increase each time by a factor of two starting from the voice-coil device (4.n) corresponding to the least significant bit and going to voice-coil devices corresponding to consecutive more significant bits. The invention enables the transducer to be constructed in a simple manner if the transducer is a moving-coil loudspeaker or if it is a ribbon-type loudspeaker.

9 Claims, 7 Drawing Figures

Figure 1:
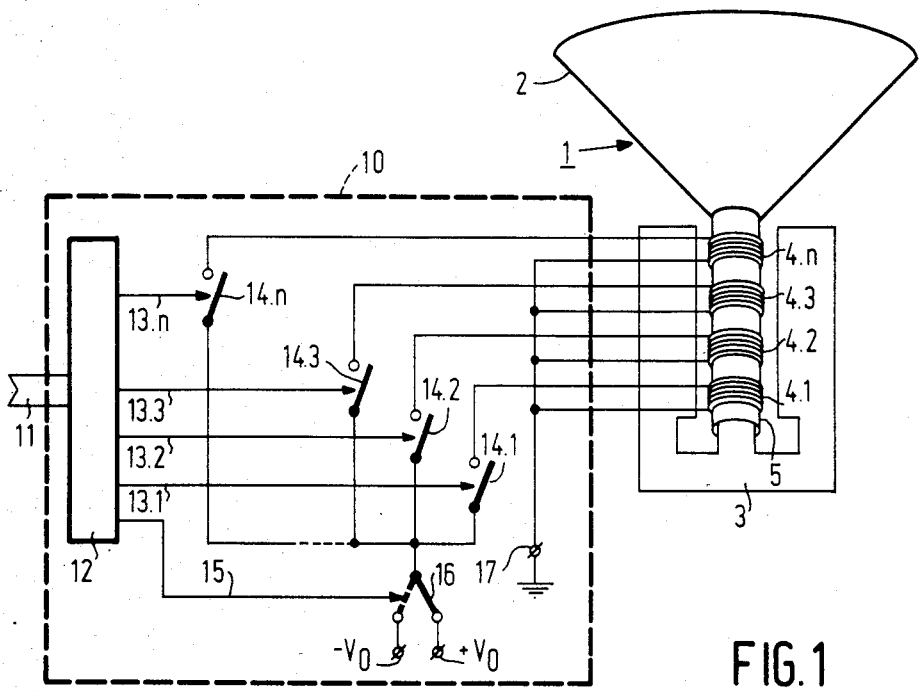
FIG. 1 PRIOR ART

LOUDSPEAKER SYSTEM FOR CONVERTING A DIGITIZED ELECTRIC SIGNAL INTO AN ACOUSTIC SIGNAL

The invention relates to a loudspeaker system for converting an n-bit digitized electric signal (n being an integer and $\geqq 2$) into an acoustic signal, which system includes an electrodynamic transducer comprising a diaphragm, a magnet system and n voice-coil devices which cooperate with the magnet system, means being provided for driving each of the n voice-coil devices in accordance with the value of a respective one of the n bits of the digitized electric signal. The invention also relates to an electrodynamic transducer for use in a loudspeaker system in accordance with the invention. A loudspeaker system of the type specified in the opening sentence is known from the publication "The acoustic characteristics of Moving-Coil type PCM digital loudspeaker (I)" by K. Inanaga and M. Nishimura, from the Proceedings of the Spring Conference of the Acoustical Society of Japan, pages 649 and 650, May 1981.

The known loudspeaker system includes an electrodynamic transducer in the form of a moving-coil loudspeaker, the voice-coil devices being arranged on a voice-coil former as separate voice coils. However, the invention is not limited to loudspeaker systems including an electrodynamic transducer in the form of a moving-coil loudspeaker. The invention also relates to a loudspeaker system including different types of electrodynamic transducers, for example ribbon-type loudspeakers in which the voice-coil devices are arranged on the diaphragm in the form of a conductive layer.

The transducer described in the afore-mentioned publication comprises a plurality of voice-coil devices each having 48 turns.

The means for driving the voice-coil devices are constructed so that the voice-coil devices are driven with switched voltages whose magnitudes vary (increase) in conformity with the significance of the bits associated with the voice-coil devices.

This means that, for driving the voice-coil devices, the known loudspeaker system requires as many supply voltages as there are voice-coil devices. Providing so many different supply voltages is very intricate, may render the system expensive, and is therefore a disadvantage. Moreover, the known loudspeaker system does not have an optimum efficiency at maximum drive. In Japanese Kokai No. 58-31699 a step is proposed in which the means for driving the voice-coil devices require only one supply voltage so that a substantially optimum efficiency is obtained at maximum drive. In accordance with this step the voice-coil devices each comprise a conductor whose length is the same for all the voice-coil devices. The conductors are made of a material whose specific mass and specific resistance are at least substantially the same for all the voice-coil devices. When an index m (m being an integer and $\leqq$n) is assigned to each said voice-coil device such that the index 1 is assigned to the voice-coil device corresponding to the most significant bit of the n bits of the digitized electric signal, consecutive indices being assigned to voice-coil devices corresponding to consecutive less significant bits of the n bits of the digitized electric signal, and the highest index to the voice-coil device corresponding to the least significant bit of the n bits of the digitized electrical signal, the ratio between the area $A_m$ of a perpendicular cross-section of the conductor of the $m^{th}$ voice-coil device and the area $A_1$ of the perpendicular cross-section of the conductor of the first voice-coil device satisfies the equation $$A_m:A_1=1:2^{m-1}$$

In general, either copper or aluminium is employed as the conductor material.

The step proposed in Japanese Kokai No. 58-31699 is based on the recognition of the fact that it is possible to drive the various voice-coil devices correctly (i.e. with the appropriate level or amplitude) even in the case of a single supply voltage, while achieving a substantially optimum efficiency.

This may be achieved by varying the currents in the voice-coil devices, the different currents being derived from a single supply voltage because of the different ohmic resistances of the voice-coil devices themselves. For equal lengths of the conductors of all the voice-coil devices, this means that, starting from the voice-coil device corresponding to the most significant bit, the perpendicular cross-sections of the conductors decrease as powers of two.

The step in accordance with Japanese Kokai No. 58-31699 is practised in that each conductor comprises only one wire, the wire diameters of the conductors corresponding to consecutively more significant bits increasing by a factor of $\sqrt{2}$. Manufacturing such a transducer is comparatively intricate and therefore expensive.

It is an object of the invention to provide a transducer which can be constructed in a simpler and consequently cheaper manner. To this end a loudspeaker system according to the invention is characterized in that the conductor of the $m^{th}$ voice-coil device comprises $p \times 2^{n-m}$ wires of equal cross-section which are arranged in parallel with each other, p being greater than or equal to one and being the number of wires of the conductor of the $n^{th}$ voice-coil device corresponding to the least significant bit and m ranging from 1 to n inclusive. The step in accordance with the invention is based on the recognition of the fact that in the manufacture of voice-coil devices it is inconvenient if wires of different diameters have to be used. Moreover, it is very difficult to manufacture wires whose diameters differ exactly by a factor of $\sqrt{2}$. It is much simpler to use wire of the same diameter, the desired perpendicular cross-sectional areas being obtained by arranging a plurality of wires in parallel.

It is to be noted that electrodynamic loudspeakers for reproducing a pulse-code-modulated electric signal are known from Japanese Kokai No. 52.121.316 and Japanese Kokai No. 57. 185.798. However, in these two electrodynamic loudspeakers the ratio between the perpendicular cross-sections is not selected in conformity with the above equation. Moreover, the loudspeaker system of Japanese Kokai No. 51.121.316 employs a current drive for the excitation of the voice-coil devices. This results in a higher electric power dissipation.

Japanese Kokai No. 58-31699 describes an electrodynamic transducer in the form of a moving-coil (cone) loudspeaker. Starting from Japanese Kokai No. 58-31699 it is possible, in accordance with the invention, to construct an electrodynamic transducer in the form of a ribbon-type loudspeaker in a very simple and cheap manner.

In a loudspeaker system equipped with an electrodynamic transducer of the ribbon type the diaphragm may comprise a plurality of superimposed foils, adjoining foils being attached to one another over their entire surface areas and at least one voice-coil device being arranged on each foil. Moreover, in such a system either the thickness of the conductive layers may be equal for all the conductors—in which case the ratios between the widths of the conductors must be such that the aforementioned equation is satisfied—or the width of the conductive layers may be equal for all the conductors—in which case the ratios between the thicknesses of the conductors must be such that the aforementioned equation is satisfied. The first mentioned possibility is preferred because the transducer can be constructed very simply by local etching of a conductive layer provided on a foil. This also enables several voice-coil devices to be arranged on one foil in a very simple manner.

Figure 2A:
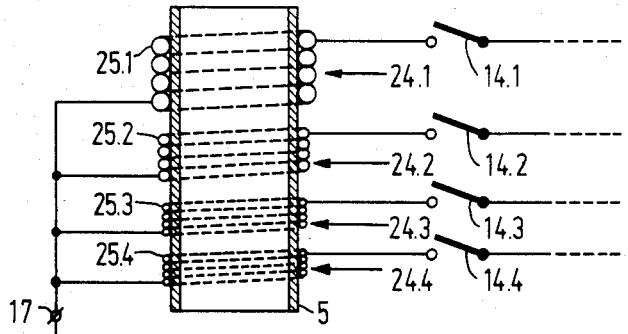
FIG. 2 A PRIOR ART
Figure 2B:
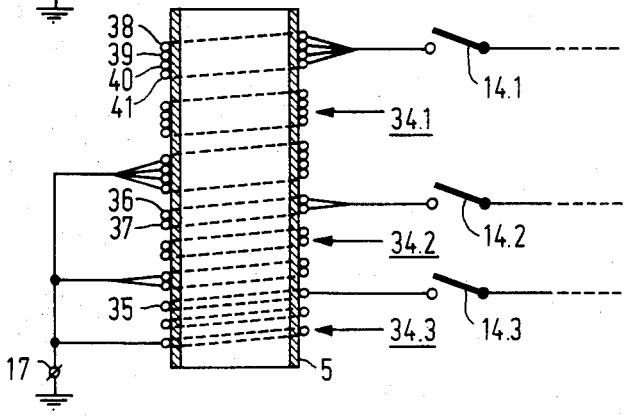
Figure 3:
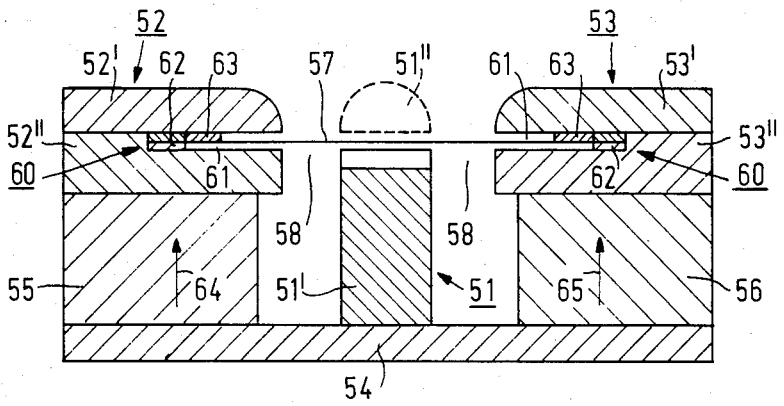
Figure 4A:
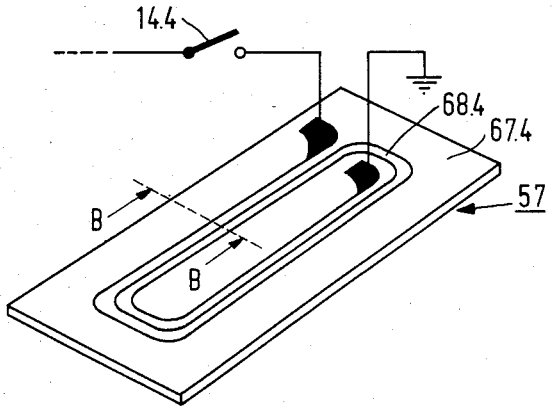
Figure 4B:
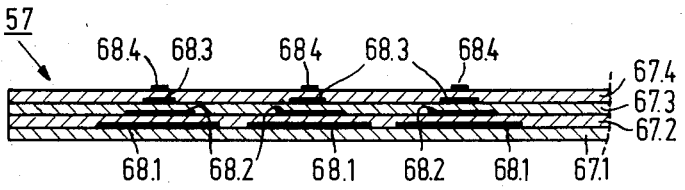
Figure 4C:
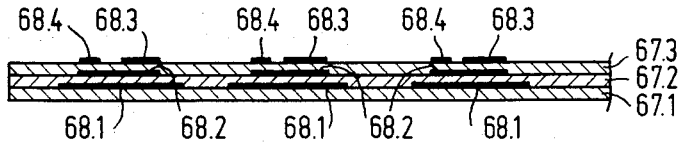

The invention will now be described in more detail, by way of example, with reference to the drawings, in which identical reference numerals in the different Figures refer to identical elements. In the drawings:

FIG. 1 shows an example of the known loudspeaker system,

FIG. 2*a* shows an example of the voice-coil devices of the known loudspeaker system, FIG. 2*b* shows an example of voice-coil devices which may be used in a loudspeaker system in accordance with the invention, FIG. 3 shows an example of a different electrodynamic transducer, namely a transducer of the ribbon type, which may be used instead of the electrodynamic transducer shown in FIG. 1, and FIG. 4*a* is a perspective view of the diaphragm of the transducer shown in FIG. 3, FIG. 4*b* shows a part of a sectional view of the diaphragm shown in FIG. 4*a*, and FIG. 4*c* shows a part of a sectional view of a different diaphragm which may be used in the transducer shown in FIG. 3.

FIG. 1 shows schematically the loudspeaker system disclosed in Japanese Kokai No. 58-31699. This system includes an electrodynamic transducer 1 equipped with a diaphragm 2, a magnet system 3 and n voice-coil devices 4.1 to 4.n cooperating with the magnet system 3, n being an integer and $\geqq 2$. The voice-coil devices each comprise a conductor, the lengths of the conductors being the same for all the voice-coil devices. The voice-coil devices are all arranged on a voice-coil former 5. This voice-coil former 5 is secured to the diaphragm 2. Means for driving the voice-coil devices bear the reference numeral 10. A digitized electric signal 11 is applied to the means 10 and, if necessary, converted in a converter 12. The digital signal comprises n bits for controlling the drive of the n voice-coil devices, and one sign bit. The n bits are applied via the lines 13.1, 13.2, 13.3, . . . 13.n to associated switches 14.1, 14.2, 14.3, . . . 14.n so as to control these switches. The sign bit is applied to a switch 16 via the line 15 to control this switch. Depending on the sign bit the switch 16 is switched between the positive and the negative supply voltage $V_o$ and $-V_o$. One of the ends of each of the coils of the voice-coil devices 4.1 to 4.n is connected to or disconnected from the positive or the negative supply voltage via a respective one of the switches 14.1 to 14.n.

The other ends of the coils of the voice-coil devices 4.1 to 4.n are connected to a point 17 of constant potential (ground). The most significant bit of the digitized electric signal is appllied to the switch 14.1 via the line 13.1 and thus controls the drive of the voice-coil device 4.1. Consecutive less significant bits are applied to the switches 14.2, 14.3, . . . via the lines 13.2, 13.3, . . . (in this sequence) and thus control the drives of the voice-coil devices 4.2, 4.3, . . . The least significant bit is applied to the switch 14.n via the line 13.n and controls the drive of the voice-coil device 4.n. The means 10 for driving the voice-coil-device sections operate so that if a bit of a high value (logic "one") is applied to the switch 14.1 via the line 13.1, this switch is closed. Conversely, if a low value (logic zero) is applied via the line 13.1, the switch 14.1 is opened. It is obvious that the same applies to the control of the other switches 14.2 to 14.n via the lines 13.2 to 13.n. If $A_m$ is the area of a perpendicular cross-section of the conductor of the voice-coil device 4.m, m ranging from 1 to n, the following equation is valid for the ratio between $A_m$ and $A_1$, $A_1$ being the area of the perpendicular cross-section of the conductor of the voice-coil device 4.1 corresponding to the most significant bit:

$$A_m:A_1=1:2^{m-1}$$

This means that, starting from the voice-coil device 4.1 corresponding to the most significant bit, the areas of the perpendicular cross-sections of the conductors of the voice-coil devices 4.2, 4.3, . . . corresponding to successive less significant bits 13.2, 13.3, . . . decrease each time by a factor of 2.

For successive less significant bits the resistance values of the conductors of the voice-coil devices increase, which means that for successive less significant bits the currents through the conductors decrease each time by a factor of 2, so that a correct drive of the voice-coil devices in conformity with the significance of the bits is achieved. In accordance with the aforementioned Japanese Kokai, the variation in the areas $A_m$ of the perpendicular cross-sections can be achieved in the manner as described with reference to FIG. 2*a*. FIG. 2*a* shows the voice-coil former 5 on which four voice-coil devices 24.1 to 24.4 are arranged. The voice-coil device 24.1 is driven in accordance with the value of the most significant bit and the voice-coil device 24.4 in accordance with the value of the least significant bit. The voice-coil device comprise conductors 25.1 to 25.4 with only one wire. In total each voice-coil device therefore comprises four turns. It is clearly visible that the areas of the perpendicular cross-sections of the wires, starting from the wire 25.1, decrease for successive wires 25.2, 25.3 and 25.4 (each time by a factor of two). In addition to the voice-coil former 5 with the voice-coil devices 24.1 to 24.4, FIG. 2*a* also shows schematically a part of the electrical conductors from the switches 14.1 to 14.4.

The construction shown in FIG. 2*a* is not very convenient because it requires four different wires of four different cross-sectional areas. Moreover, the ratios between the diameters vary in accordance with the inconvenient factor $\sqrt{2}$.

A more convenient solution is shown in FIG. 2*b*.

Here, the conductor of the $m^{th}$ voice-coil device comprises $p\times 2^{n-m}$ wires of equal cross-section which are arranged in parallel with each other. Here, p is greater than or equal to one and is the number of wires of the conductor of the voice-coil device corresponding to the least significant bit. Also, m ranges from 1 to n. An example is shown in FIG. 2*b*. FIG. 2*b* shows a voice-coil former 5 on which three voice-coil devices 34.1, 34.2 and 34.3 are arranged. The voice-coil device 34.3 is driven in accordance with the value of the least significant bit and comprises a conductor having only one wire 35, i.e. p=1. The next voice-coil device 34.2 consequently comprises two wires 36 and 37. The voice-coil device 34.1 comprises four wires 38 to 41.

As is apparent from FIG. 2*b* the two wires are arranged electrically in parallel with one another as are the four wires. For this purpose some of the electrical conductors from the switches 14.1, 14.2 and 14.3 are also shown schematically. It is evident that the voice-coil devices need not necessarily be arranged above one another and slightly spaced from each other on the voice-coil former as shown in FIGS. 1, 2*a* and 2*b*. Of course, it is equally possible to arrange the conductors of all the voice-coil devices together on the voice-coil former.

Another electrodynamic transducer in accordance with the invention is shown in FIG. 3. The transducer shown in FIG. 3 is an electrodynamic transducer of the ribbon type. Such a transducer is known from, for example, Netherlands Patent Application No. 79.03.908, which has been laid open to public inspection. FIG. 3 shows an improved version of the transducer as described in U.S. Pat. No. 4,484,037. The transducer may have a circular or rectangular shape. FIG. 3 is a sectional view of a rectangular transducer taken in a direction perpendicular to the longitudinal direction of the conductors in an air gap. The magnet system of the transducer comprises a centre pole 51, an upper plate 52, 53, a lower plate 54, and the parts 55 and 56. The magnetic field in the magnet system can be obtained by constructing the parts 55 and 56 as permanent magnets. The direction of magnetization is indicated by the arrows 64 and 65. The directions of magnetization may also be reversed. The other parts of the magnet system are made of a soft-magnetic material, for example soft-iron.

In the rectangular version 55 and 56 denote the cross-sections of two rod-shaped magnets which extend parallel to one another. It is alternatively possible that the parts 55 and 56 be made of a soft-magnetic material and the centre pole, at least its shaded portion 51', be constructed as a permanent magnet. Air gaps 58 are formed between the upper plate 52 and the centre pole 51 and between the upper plate 53 and the centre pole 51, which gaps extend parallel to one another. A diaphragm 57 is arranged in the air gaps 58. The construction of the diaphragm 57 will be described hereinafter with reference to FIG. 4.

The upper plates 52 and 53 each comprise two plate-shaped parts 52', 52'' and 53', 53''. The two plate shaped parts of each pair 52', 52'' and 53', 53'' abut against each other over part of their facing major surfaces, which major surfaces are disposed substantially in and parallel to the plane of the diaphragm. Another part of said major surface of one of each pair of plate-shaped parts recedes slightly as indicated by 60, so that a space 61 is formed. The diaphragm 57 is arranged between the plate-shaped parts 52', 52'' and 53', 53'' in a manner such that an edge portion of the diaphragm is disposed in the said spaces 61. The diaphragm 57 may be tensioned on or in a frame 62 which is mounted between the two plate-shaped parts of each pair. However, alternatively the diaphragm may be clamped between the parts 52', 52'' and 53', 53'' themselves. Moreover, a damping material may be provided in the spaces 61. The Figure shows a damping material 63 which is present only on the upper side of the diaphragm and is in mechanical contact with this diaphragm. Preferably, the damping material will be provided on both sides of the diaphragm. This damping material damps the higher natural resonances of the diaphragm (i.e. free vibrations of the diaphragm in a pattern corresponding to a natural frequency of the diaphragm, excited by the drive of the diaphragm). Preferably, the centre pole 51 also extends to the other side of the diaphragm. The part 51'' disposed on this side of the diaphragm is indicated by a broken line. Preferably, the part of the diaphragm which is disposed between the two parts 51 and 51'' of the centre pole is freely movable. The part 51'' is kept in the position shown by means of a support, not shown. For a better impedance matching to the medium in which the transducer radiates its acoustic signals the end faces of the parts 51'', 52' and 53' which face the air gap 58 are rounded. This means that these end faces diverge further from each another in a direction parallel to the diaphragm surface as the distance from the diaphragm surface increases, so that a horn-like radiation aperture is formed.

FIG. 4*a* is a perspective view of the diaphragm 57 and FIG. 4*b* is a sectional view of the left half of the diaphragm 57 taken on the line B—B in FIG. 4*a*. The left half of the diaphragm shown in FIG. 4*a* (i.e. the part shown in FIG. 4*b*) is disposed at the location of the air gap 58 between the part 52 and the centre pole 51 of the transducer shown in FIG. 3. The right-hand half of the diaphragm is disposed at the location of the air gap 58 between the part 53 and the centre pole 51. The direction of the magnetic field in the two air gaps 58 and the direction of the signal currents in the conductors in these air gaps are such that the excursion of the diaphragm is oriented in the same direction over the entire diaphragm area. Such a transducer is sometimes referred to as an isophase transducer.

The diaphragm 57 comprises a plurality (in the present case four) of superimposed foils 67.1, 67.2, 67.3, 67.4. Adjoining foils are attached to each other over their entire areas. At least one voice-coil device is arranged on each foil. In FIG. 4*a* only the voice-coil device 68.4 on foil 67.4 is visible. The foils 67.1, 67.2, and 67.3 are provided with voice-coil devides 68.1, 68.2 and 68.3 respectively.

The voice-coil device take the form of conductors which are arranged on the foils as electrically conductive layers. The conductors of the voice-coil devices again have the same length. Each conductor comprises three turns. FIG. 4*b* shows an example in which the thickness of the conductive layer is the same for all the conductors. FIG. 4*a* also shows the electrical connections from the switch 14.4 for the drive in accordance with the value of the least significant bit. The voice-coil devices 68.3 and 68.2 (in this order) are driven in accordance with the values of successive more significant bits. The voice-coil device 68.1 is driven in accordance with the value of the most significant bit. In order to satisfy the aforementioned equation for the ratio between the areas of the perpendicular cross-sections of the conductors the width of the conductors corresponding to successive more significant bits should always increase by a factor of two when the conductors have the same thickness. This is shown in FIG. 4*b*. Another possibility is to make the conductive layer equally wide for all the conductors. In that case the ratio between the thicknesses of the conductors should always increase by a factor of two.

It is not necessary that only one voice-coil device be arranged on each foil. In the version shown in FIG. 4*b* for example it is possible that the diaphragm 57 comprises only three foils, namely 67.1, 67.2, 67.3, the voice-coil devices 68.1 and 68.2 being arranged on the foils 67.1 and 67.2 respectively and the voice-coil devices 68.3 and 68.4 being both arranged on the foil 67.3. FIG. 4*c* shows an example of this. It is to be noted that the invention is not limited to the embodiments shown. The invention is equally applicable to constructions which differ from the embodiments shown with respect to points which are not relevant to the inventive idea.

What is claimed is:

1. A loudspeaker system for converting an n-bit digitized electric signal (n being an integer and $\geqq 2$) into an acoustic signal comprising: an electrodynamic transducer comprising a diaphragm, a magnet system and n voice-coil devices which cooperate with the magnet system, means for driving each of the n voice-coil devices in accordance with the value of a respective one of the n bits of the digitized electric signal, said voice-coil devices having conductors of the same length and being made of a material of the same specific mass and specific resistance for all the voice-coil devices, an index m (m being an integer and $\leqq$n) being assigned to each said voice-coil device with an index 1 assigned to a first voice-coil device which corresponds to the most significant bit of the n bits of the digitized electric signal, and with consecutive indices to voice-coil devices corresponding to consecutive less significant bits of the n bits of the digitized electric signal and with the highest index assigned to the voice-coil device corresponding to the least significant bit of the n bits of the digitized electric signal, whereby the ratio between an area $A_m$ of the perpendicular cross-section of the conductor of the $m^{th}$ voice-coil device and an area $A_1$ of the perpendicular cross-section of the conductor of the first voice-coil device satisfies the equation:

$$A_m:A_1=1:2^{m-1}$$

characterized in that the conductor of the $m^{th}$ voice-coil device comprises $p\times 2^{n-m}$ wires of equal cross-section connected in parallel with each other, p being greater than or equal to one and being the number of wires of the conductor of the $n^{th}$ voice-coil device corresponding to the least significant bit and m ranging from 1 to n inclusive.

2. A loudspeaker system for converting an n-bit digitized electric signal (n being an integer and $\geqq 2$) into an acoustic signal comprising: an electrodynamic transducer comprising a diaphragm, a magnet system and n voice-coil devices which cooperate with the magnet system, means for driving each of the n voice-coil devices in accordance with the value of a respective one of the n bits of the digitized electric signal, said voice-coil devices each comprising a conductor of the same length with the conductors being made of a material of the same specific mass and specific resistance for all the voice-coil devices, an index m (m being an integer and $\leqq$n) being assigned to each said voice-coil device with an index 1 assigned to the first voice-coil device which corresponds to the most significant bit of the n bits of the digitized electric signal, and with consecutive indices assigned to voice-coil devices corresponding to consecutive less significant bits of the n bits of the digitized electric signal and with the highest index assigned to the voice-coil device corresponding to the least significant bit of the n bits of the digitized electric signal, whereby the ratio between the area $A_m$ of a perpendicular cross-section of the conductor of the $m^{th}$ voice-coil device and the area $A_1$ of the perpendicular cross-section of the conductor of the first voice-coil device satisfies the equation:

$$A_m:A_1=1:2^{m-1},$$

characterized in that the electrodynamic transducer is a transducer of the ribbon-type, the diaphragm comprises a plurality of superimposed foils with adjoining foils being attached to each other over their entire surface areas, and at least one voice-coil device being arranged on each foil.

3. A loudspeaker system as claimed in claim 2 wherein the conductors of the voice-coil devices are each arranged on the associated foil in the form of an electrically conductive layer, characterized in that the thickness of the conductive layer is the same for all the conductors and the ratios between the widths of the conductors are such that the said equation is satisfied.

4. A loudspeaker system as claimed in claim 2, wherein the conductors of the voice-coil devices are each arranged on the associated foil in the form of an electrically conductive layer, characterized in that the width of the conductive layer is the same for all the conductors and the ratios between the thickness of the conductors are such that the said equation is satisfied.

5. A loudspeaker system for converting an n-bit digitized electric signal into an acoustic signal comprising: a magnet system with an air gap, a coil former with a plurality n of voice-coil devices thereon located at least partly within said air gap, a diaphragm coupled to the coil former, means for selectively driving the voice-coil devices in accordance with respective bits of a digitized electric signal, said voice-coil devices each comprising a conductor of the same length and same diameter, and wherein an index m is assigned to each voice-coil device with an index 1 assigned to the voice-coil device corresponding to the most significant bit (MSB) of the n-bit digitized signal and with consecutive indices assigned to voice-coil devices corresponding to consecutive less significant bits of the n-bit digitized signal and with the highest index assigned to the voice-coil device corresponding to the least significant bit (LSB) of the digitized signal, the conductor of an $m^{th}$ voice-coil device comprising $p\times 2^{n-m}$ equal diameter wires connected in parallel with each other so that the following relationship is satisfied:

$$A_m:A_1=1:2^{m-1}$$

where $A_m$ is the cross-section area of the conductor of the $m^{th}$ voice-coil device, $A_1$ is the cross-section area of the conductor of the MSB voice-coil device, m is an integer varying from 1 to n, and wherein $p\geqq 1$ and is the number of wires of the conductor of the $n^{th}$ voice-coil device which corresponds to the LSB of the n-bit digitized signal.

6. A loudspeaker system as claimed in claim 5 wherein $n=3$ and $p=1$ so that the voice-coil device corresponding to the LSB comprises a conductor with only one wire, the voice-coil device corresponding to $m=2$ comprising a conductor with two wires connected in parallel ($p\times 2^{n-m}=1\times 2^{3-2}=2$), and the voice-coil device corresponding to the MSB comprises a conductor with four wires connected in parallel ($p \times 2^{n-m} = 1 \times 2^{3-1} = 4$).

7. A loudspeaker system as claimed in claim 5 wherein said driving means includes a plurality n of switching devices controlled by individual bits of the n-bit digitized signal so as to selectively apply a common voltage to said voice-coil devices.

8. A loudspeaker system as claimed in claim 3 wherein at least one of said foils has two voice-coil devices arranged thereon.

9. A loudspeaker system as claimed in claim 4 wherein at least one of said foils has two voice-coil devices arranged thereon.

* * * * *